United States Patent [19]

Schadewald

[11] Patent Number: 4,515,482

[45] Date of Patent: May 7, 1985

[54] STERILE SUSPENSION AND SOLUTION HOLDING AND MIXING TANK

[75] Inventor: Frederic H. Schadewald, Ross Township, Kalamazoo County, Mich.

[73] Assignee: The Upjohn Company, Kalamazoo, Mich.

[21] Appl. No.: 583,781

[22] Filed: Feb. 28, 1984

Related U.S. Application Data

[63] Continuation of Ser. No. 522,434, Aug. 11, 1983, abandoned.

[51] Int. Cl.[3] ..... B01F 15/00

[52] U.S. Cl. ..... 366/136; 366/262; 366/298

[58] Field of Search ..... 241/46, 11, 80, 95, 241/97; 277/62, 63, 64, 102, 112, 125; 366/136, 137, 189, 192, 244, 245, 247, 249, 250, 262, 263, 264, 265, 290, 291, 298, 299; 384/147, 151, 152

[56] References Cited

U.S. PATENT DOCUMENTS

| | | | |
|---|---|---|---|
| 1,079,481 | 11/1913 | Euston . | |
| 1,445,427 | 2/1923 | Werner . | |
| 1,588,901 | 6/1926 | Merrell . | |
| 1,722,433 | 7/1929 | Kirschbraun . | |
| 1,781,435 | 11/1930 | Carper . | |
| 1,782,370 | 11/1930 | Smith . | |
| 1,789,320 | 1/1931 | Overbury . | |
| 1,789,897 | 1/1931 | Gregg . | |
| 1,884,664 | 10/1932 | Gregg . | |
| 2,086,539 | 7/1937 | Bethune | 366/262 |
| 2,126,911 | 8/1938 | Mullen . | |
| 2,137,328 | 11/1938 | Bissell . | |
| 2,146,566 | 2/1939 | Daman . | |
| 2,148,608 | 2/1939 | deStubner . | |
| 2,390,898 | 12/1945 | Rechtin et al. . | |
| 2,482,235 | 9/1949 | Becchia . | |
| 2,586,781 | 2/1952 | Shields | 277/112 |
| 2,635,860 | 4/1953 | McLeod . | |
| 2,718,385 | 9/1955 | Greblick | 366/264 |
| 2,769,623 | 11/1956 | Cawood . | |
| 2,791,407 | 5/1957 | Harrison . | |
| 2,985,389 | 5/1961 | Willems . | |
| 2,997,373 | 8/1961 | Stephens . | |
| 3,081,981 | 3/1963 | Kunz | 366/137 |
| 3,112,634 | 12/1963 | Klykken . | |
| 3,169,776 | 2/1965 | Felt . | |
| 3,170,638 | 2/1965 | Burton . | |
| 3,184,221 | 5/1965 | Mould, Jr. . | |
| 3,192,942 | 7/1965 | Manor | 277/112 |
| 3,326,815 | 6/1967 | Werner et al. . | |
| 3,415,650 | 12/1968 | Frame et al. . | |
| 3,421,477 | 1/1969 | Gilbert et al. . | |
| 3,606,260 | 9/1971 | Rubin . | |
| 3,608,912 | 9/1971 | Templin | 277/102 |
| 3,675,903 | 7/1972 | Harper . | |
| 3,677,477 | 7/1972 | Watson et al. . | |
| 4,299,395 | 11/1981 | Reed . | |
| 4,357,111 | 11/1982 | Honemeyer et al. . | |

FOREIGN PATENT DOCUMENTS

| | | |
|---|---|---|
| 475987 | 1/1975 | Australia . |
| 652360 | 11/1962 | Canada . |
| 483569 | 9/1929 | Fed. Rep. of Germany . |
| 872928 | 2/1953 | Fed. Rep. of Germany . |
| 1190439 | 1/1966 | Fed. Rep. of Germany . |
| 1230397 | 12/1966 | Fed. Rep. of Germany . |
| 1242817 | 6/1967 | Fed. Rep. of Germany . |
| 2805942 | 8/1979 | Fed. Rep. of Germany . |
| 5667531 | 11/1979 | Japan . |
| 365420 | 1/1932 | United Kingdom . |
| 523340 | 7/1940 | United Kingdom . |
| 677787 | 8/1952 | United Kingdom . |
| 722462 | 1/1955 | United Kingdom . |
| 986992 | 3/1965 | United Kingdom . |
| 1309737 | 3/1973 | United Kingdom . |

*Primary Examiner*—Robert W. Jenkins

*Assistant Examiner*—Arthur D. Dahlberg

*Attorney, Agent, or Firm*—Flynn, Thiel, Boutell & Tanis

[57] ABSTRACT

An apparatus for the preparation of sterile suspensions and solutions is disclosed which includes a container wherein a starting mixture is subjected to high intensity mixing by means of a high speed, high shear external mixer disposed in an external recirculation loop. The mixer used in the present invention is a revolving hollow cylinder open at the bottom thereof and having grooves in the sides thereof, such that the mixture is drawn through the bottom of the mixer head and forced radially outwardly through the grooves. The mixer head is preferably disposed in the upper leg of a T-shaped fitting of the recirculation loop, and a special shaft seal is used to prevent leakage of the materials being treated along the drive shaft used to rotate the mixer head.

19 Claims, 6 Drawing Figures

STERILE SUSPENSION AND SOLUTION HOLDING AND MIXING TANK

This application is a continuation, of U.S. Ser. No. 522,434, filed Aug. 11, 1983, now abondoned.

FIELD OF THE INVENTION

This invention relates to an apparatus for the preparation of a suspension, emulsion or solution, for example, a sterile suspension of fine particles of a pharmaceutical substance in a liquid vehicle. The apparatus of the invention is particularly adapted for preparing pharmaceutical suspensions and emulsions in which the disperse phase is of extremely small size. The apparatus is simple in structure so that it can be readily sterilized.

BACKGROUND OF THE INVENTION

In the preparation of a suspension, emulsion or solution from a mixture of starting materials, it is a known technique to mix the starting materials in a tank and continuously circulate a portion of the resulting mixture through an external homogenizing or emulsifying unit. The external homogenizing unit is typically designed so that a small portion of the reaction mixture is continuously withdrawn from the bottom of the tank and is returned above it to the tank. Thus, the incompletely homogenized starting materials that may be present at the bottom of the tank are withdrawn therefrom, passed through the external homogenizing or emulsifying unit and then returned to the tank.

Colloid mills are typically employed as external homogenizing or emulsifying units, although a wide variety of other mixers and grinders have also been employed for this purpose. Colloid mills break up agglomerates of solid particles or subdivide droplets of a dispersed liquid, by means of high speed fluid shear. A typical colloid mill employs a rotor which rotates rapidly within and close to the surface of a stator. The materials to be formed into a fine dispersion are fed between the rotor and the stator and thereby are subjected to intense shear and centrifugal force whereby the dispersion is formed. Colloid mills are complex in structure and they are not easy to sterilize. Moreover, they generate a considerable amount of heat during operation, which makes it troublesome to use them to form compositions containing heat-sensitive materials.

Concerning mixers generally, a wide variety of mixers with various mixer head designs are known and are in common use. One known type of mixer employs, as a mixing head, a rotatable tubular member having radial slots in the side wall thereof. The fluid to be homogenized is drawn axially into the interior of the rotating tubular head and then is expelled radially outwardly through the slots by centrifugal force, whereby the starting materials are intensively mixed. Fins or blades are often disposed within the tubular mixer head to enhance the mixing action.

Commonly a mixer head is disposed inside a casing and is rotated by a drive shaft which is driven by a motor located outside of the casing. In such a construction, it is necessary to provide a mechanical seal around the drive shaft to prevent leakage of the material being mixed. A wide variety of mechanical seals, including seals having various configurations of O-rings and sealing rings, have been employed. However, it has been difficult to obtain, at reasonable cost, an effective mechanical seal for use with rotatable, high speed, tubular mixer heads.

In the preparation of pharmaceutical suspensions and emulsions, it is important to minimize and, if possible, eliminate foaming within the main mixing tank of the apparatus. When vigorous agitation is employed within the main mixing tank, vortex formation occurs and an excessive amount of foam can be produced. In the preparation of pharmaceutical suspensions and emulsions, it has been difficult to achieve intensive mixing of the starting materials without simultaneously causing excessive foaming in the main mixing tank.

A further problem with devices for the preparation of pharmaceutical suspensions and emulsions stems from the need periodically to sterilize the entire interior of the apparatus. It is preferred to sterilize a mixing apparatus by exposing it to steam under pressure for a suitable period of time. If the mixing apparatus, however, is of complex internal structure, it may not be possible to readily sterilize it, as is, by steam under pressure. Thus, additional time and expense will be required to sterilize such a complex mixing apparatus, which is undesirable.

Accordingly, it is an object of the present invention to provide a mixing apparatus for forming a suspension, emulsion or solution, which apparatus is capable of producing a very homogenous product without causing excessive foaming in the main mixing tank.

It is a further object of the invention to provide a mixing apparatus, as aforesaid, which is particularly adapted for preparing pharmaceutical solutions, emulsions and suspensions and which apparatus can be easily cleaned and sterilized, preferably with pressurized live steam.

An additional object of the invention is to provide a mixing apparatus, as aforesaid, in which a mixture of materials to be formed into a suspension, emulsion or solution is withdrawn from the bottom of a main mixing tank and is flowed through an external recirculation loop wherein the mixture is subjected to high shear forces effective to form the withdrawn materials into the desired suspension, emulsion or solution, and then the suspension, emulsion or solution is returned to the main tank.

A further object of the invention is to provide a mixing apparatus for the preparation of suspensions, emulsions and solutions, as aforesaid, which includes an improved shaft seal for preventing leakage of the solution, emulsion or suspension around the drive shaft used to rotate the mixer head.

Other objects and advantages of the present invention will be apparent from the following specification, taken in conjunction with the accompanying drawings.

SUMMARY OF THE INVENTION

Figure 1:
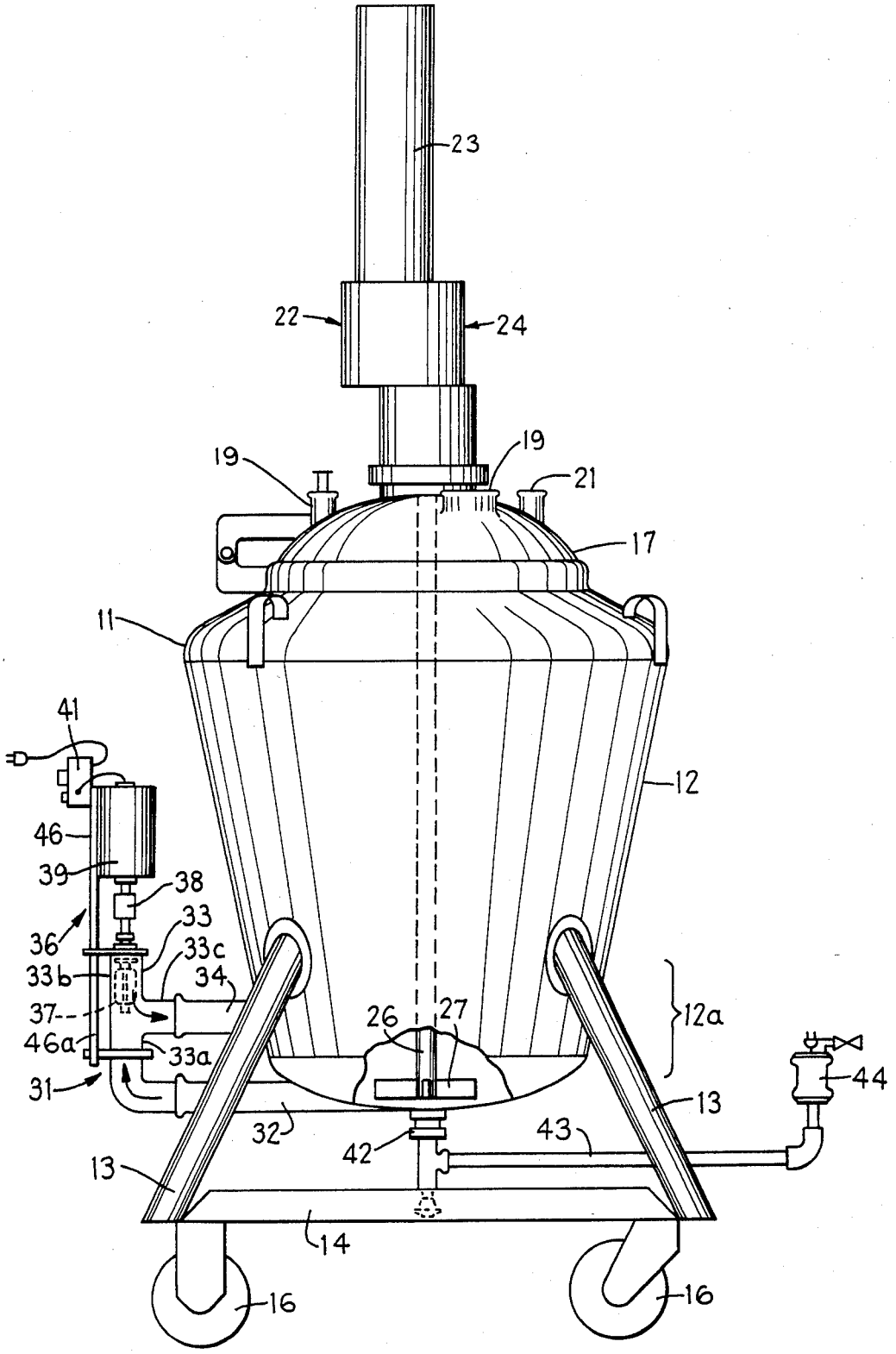
FIG. 1 is a partially broken away, front view of a mixing apparatus for preparing suspensions, emulsions and solutions according to the present invention.

The present invention provides a mixing apparatus for preparing suspensions, emulsions or solutions from a mixture of (1) a liquid carrier or vehicle material and (2) one or a mixture of two or more solid or liquid additive materials. The starting materials are blended in a closed tank. Successive portions of the mixture are continuously withdrawn and recirculated through an external recirculation loop connected to the tank, which loop contains a high-speed, high-shear mixer. This mixer is preferably located substantially completely in a recess which adjoins and communicates with the remainder of the external recirculation loop. The mixture of the starting materials is drawn into the external recirculation loop from a withdrawal location near to the bottom of the tank and the resulting homogenized suspension, emulsion or solution is returned to a return location also near to the bottom of the tank, but above the withdrawal location at which the mixture is drawn into the external recirculation loop. Over a period of time, the mixing apparatus of the present invention converts the entirety of the starting mixture into a homogeneous suspension, emulsion or solution. The apparatus of the invention is particularly well adapted for forming sterile pharmaceutical suspensions in which the solid phase consists of extremely fine powder material.

It is preferred, according to the present invention, that the high-speed, high-shear mixer head is located within a recess or dead-end branch of an otherwise continuous, single conduit forming the external recirculation loop. In the most preferred embodiment, the mixer head is located within one leg of a substantially T-shaped fitting or conduit forming part of the external recirculation loop. The T-shaped fitting preferably has a pair of leg or cross-bar portions which are disposed substantially coaxial with and communicating with each other and which jointly define the cross-bar of the T. The T-shaped fitting also comprises a stem portion extending from the juncture of the two leg portions at an angle, preferably an angle of 90°, to the common axis of the two leg portions.

Preferably, the mixer head is a rotatable tubular member having a plurality of circumferentially spaced apart, radial slots in the side wall thereof. The tubular member is mounted in one of said two leg portions of said T-shaped fitting and is rotatable about the common axis of said leg portions. When the tubular member is rotated rapidly, the mixture is drawn from the tank into the other leg portion of the T-shaped fitting of the external recirculation loop and then flows into the one leg in which the mixer head is disposed. The mixture then flows axially into the center of the mixer head at the inner end thereof and then flows radially outwardly through the slots in the mixer head, thereby subjecting the mixture to high-intensity shear whereby to homogenize and dissolve, emulsify or disperse the additive material in the liquid vehicle. The thus-formed suspension, emulsion or solution then leaves the region surrounding the mixer head in the form of an annular stream which flows in the reverse axial direction, relative to the axial flow of the incoming mixture. The annular stream flows countercurrent to and substantially surrounds the centrally located, axial flow of the incoming mixture, and then flows as a unitary stream into the stem portion of the T-shaped fitting. The homogenized mixture then is returned to the tank via the return portion of the external recirculation loop.

In a particularly preferred embodiment, the drive shaft used to rapidly rotate the mixer head is sealed by a plurality of annular flexible lip seals alternately stacked with a plurality of elastomeric O-rings and secured in a seal housing to prevent leakage of fluid from the mixer head around the drive shaft.

DETAILED DESCRIPTION

Referring to FIG. 1, there is illustrated a preferred embodiment of an apparatus, according to the invention, for producing a solution, emulsion or suspension. The apparatus 11 includes a mixing tank 12 which is mounted by means of legs 13 on a movable base 14 provided with wheels 16.

For the purpose of preparing pharmaceutical suspensions, emulsions and solutions, the tank 12 is preferably made of electropolished stainless steel and has a capacity of several hundred liters, for example, 200 liters.

The mixing tank 12 is provided with a central hatch 17 on the upper side thereof. An inlet 18 is formed in the hatch 17 for addition of additive materials into the tank 12. A second inlet 19 is provided in the hatch 17 for addition of a liquid vehicle into the tank 12. A steam inlet 21 is provided in the hatch 17 for the introduction of live, pressurized steam when it is desired or required to sterilize the interior of the mixing tank 12 and the parts associated therewith. An agitation apparatus 22 including a motor 23, a speed reducer 24, a drive shaft 26, and a turbine blade agitator head 27, is disposed centrally with respect to the tank so that the shaft 26 extends into the tank through the top of the hatch 17. The motor has a variable speed control which controls the speed of rotation of the shaft 26 so that the turbine blade agitator head 27 stirs the contents of the tank 12 at an appropriate, relatively low speed. Such relatively gentle stirring is effective to blend the ingredients without causing substantial foaming, but is normally not sufficiently intensive to form a fine homogeneous suspension or emulsion. The materials to be homogenized are added to the tank 12 in a quantity sufficient to fill the tank to a level above the return tube 34 so air will not be added by the high intensity mixer. The agitator head 27 can be of any suitable conventional design effective for blending the starting materials and maintaining materials suspended during filling operations.

High intensity mixing effective to form the desired suspension, emulsion or solution is accomplished in the external recirculation loop 31. The external recirculation loop 31 comprises a first conduit or pipe 32 which communicates with the tank 12 near to or at the bottom thereof, a T-shaped fitting or conduit 33 having a bottom leg **33*a* which communicates with the conduit 32, a top leg 33*b* and a stem portion 33*c*. The stem portion 33*c* is connected to a return conduit or pipe 34 which communicates with the tank 12 near to the bottom thereof, but at a location substantially above the location at which the conduit 32 communicates with the tank 12. Preferably, both conduits 32 and 34 communicate with the tank 12 at the vertically lowermost quarter 12*a*** of the tank.

A high-speed, high-shear mixer 36 comprises a rotatable mixer head 37 disposed within the upper leg **33*b* of the T-shaped conduit 33, a drive assembly 38 functionally connected to the mixer head 37 for effecting high-speed rotation thereof, a motor 39 for driving the drive assembly 38, and a control unit 41 for controlling operation of the mixer 36. The control unit 41 is conveniently mounted by means of a fixture 46 on the external recirculation loop 31**.

Figure 2:
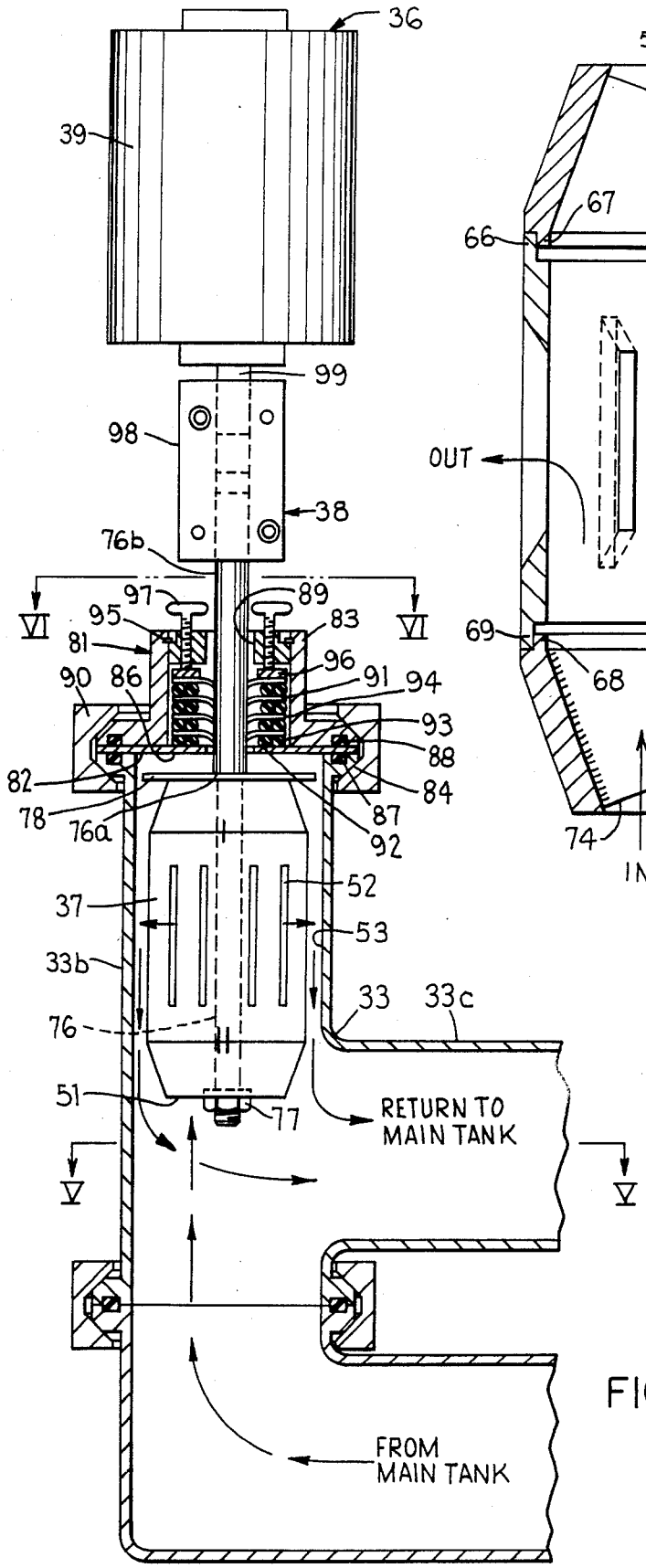
FIG. 2 is an enlarged front view, partially in section, showing the external recirculation loop portion of the apparatus, according to the invention, including the mixer head.
Figure 5:
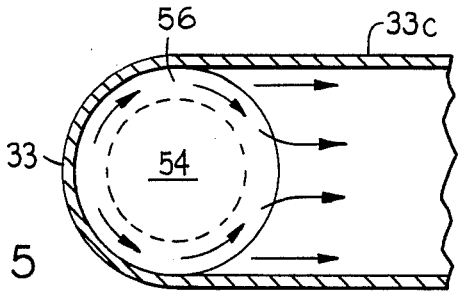
FIG. 5 is a schematic view taken along the line V—V in FIG. 2, showing the flow pattern at this portion of the external recirculation loop.

The overall operation of the external recirculation loop 31 and mixer 36 will be explained with reference to FIGS. 1, 2 and 5. As shown in FIG. 2, material from the main tank 12 is drawn through the conduit 32 into the T-shaped conduit 33 at the lower end of the bottom leg 33*a* thereof. The material then flows upwardly through the bottom leg 33*a* of the T-shaped fitting 33 and thence flows in the form of a central stream 54 into the central opening 51 at the lower end of the mixer head 37. The material flows axially upwardly within the mixer head 37 and is then expelled radially outwardly through the slots 52 formed on the central portion of the mixer head 37. The material then flows downwardly through the narrow annular channel 53 defined between the interior of the upper leg 33*b* of the T-shaped conduit 33 and the exterior of the mixer head 37. When the material reaches the level of stem portion 33*c*, it then moves laterally, parting around the central, upwardly moving material 54 entering the opening 51, so as to form an annular flow 56 which merges to form a unitary flow in the stem portion 33*c* of the T-shaped conduit 33, as shown in FIG. 5. The united flow then flows through the conduit 34 and returns to the main tank 12 from the end of the conduit 34.

It will be appreciated that the two flows 54 and 56 are not completely isolated from each other in the zone immediately below the inlet opening 51 of the mixing head. Thus, some mixing of the two streams is possible at the interface between them. The apparatus, however, is effective over a period of time to treat all of the contents of the tank to obtain a homogeneous suspension, emulsion or solution.

Upon completion of the preparation of the suspension or solution by the combined action of the agitator 22 and the mixer 36, the product suspension, emulsion or solution is withdrawn through a product outlet 42 formed on the bottom of the tank 12, travels through a product conduit 43 and is withdrawn from an outlet 44 which is located to the side of the tank 12. In the preparation of a pharmaceutical suspension, the product can be removed from the outlet 44 by means of suction, and can be optionally filtered through a filter screen after leaving the outlet 44 prior to packaging. A 100 mesh filter screen is typically used for this purpose.

Figure 3:
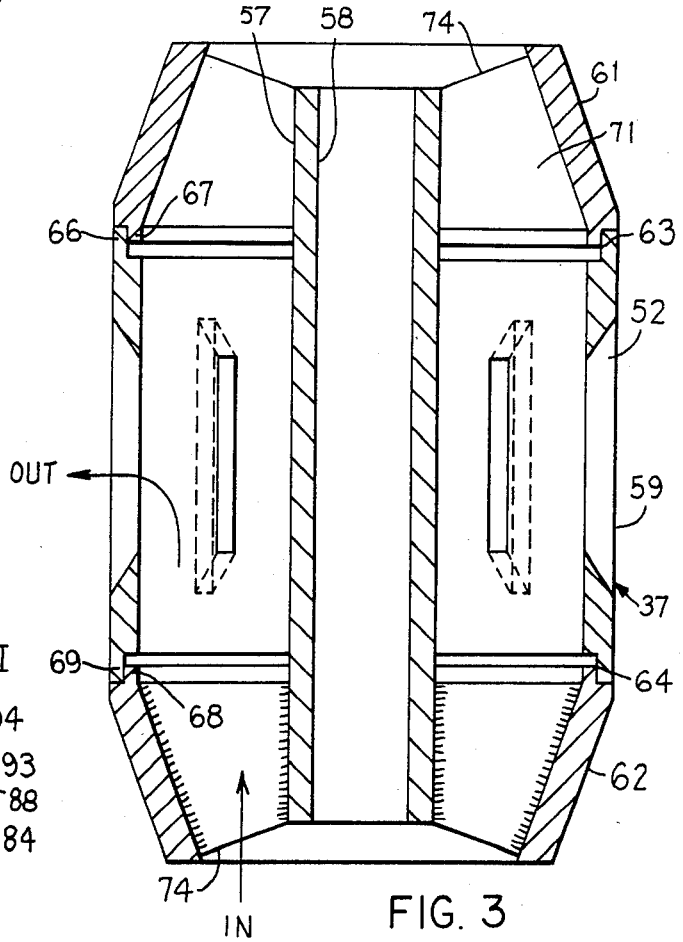
FIG. 3 is a sectional view of the mixer head shown in FIG. 2.
Figure 4:
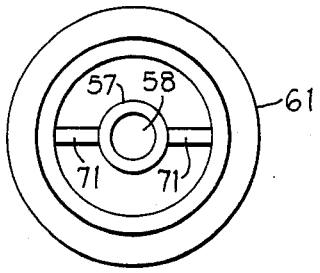
FIG. 4 is a top view of the mixer head shown in FIG. 3.

The details of the structure of the mixer head 37 are shown in FIGS. 3 and 4. The mixer head 37 comprises a central sleeve or hub 57 which defines a cylindrical bore 58. The middle portion of the hollow mixer head 37 comprises a central cylinder 59 which defines the side wall of the mixer head, is concentric with the bore 58 and has a plurality of circumferentially spaced-apart, axially elongated, thin openings therein which form the radial outlet slots 52. For example, there can be eight slots 52 spaced 45° apart from each other. The outlet slots 52 can increase in length in the radially outward direction, as indicated by broken lines in FIG. 3. The central cylinder 59 is coaxially centered on the central hub 57 by a pair of imperforate, upper and lower, end cones or frusto-conical members 61 and 62, respectively. The end cones 61 and 62 decrease in diameter in the axially outward direction relative to the center of the mixer head. The end cones 61 and 62 interlock with the central cylinder 59 at upper and lower interlocking portions 63 and 64, respectively. The interlocking portions 63 and 64 each comprise a pair of oppositely axially extending, overlapping, annular flanges 66, 67 and 68, 69, wherein the interior flanges 67 and 68 of the pairs are formed on the end cones 61 and 62, respectively. A plurality of fins 71 extend radially from the central hub 57 to each of the end cones 61 and 62. The fins 71 are secured, as by welding, to the central hub 57 and to the end cones 61 and 62. The fins 71 are generally made of relatively thin stock, for example, a sheet about 0.09 inches thick. The fins 71 taper outwardly at the axially outward ends thereof 74. Preferably, two fins 71 are associated with each of the end cones 61 and 62. When two fins are used at each end, the fins are spaced apart at intervals of 180°, as shown in FIG. 4.

The lower portion of the drive shaft 76 extends through the bore 58. A nut 77, or other suitable fastening means, is secured at the lower end of the drive shaft 76 and engages the bottom of the mixer head 37. The upper end of the mixer head 37 abuts against a top plate 78 which in turn abuts against a radially enlarged shoulder 76*a* of the drive shaft 76 above the mixer head 37. The mixer head 37 is thus rigidly secured between the top plate 78 and the nut 77, and the mixer head 37 thereby rotates integrally with the drive shaft 76. The top plate 78 seals the top of the mixer head 37 and provides positive pressure on the shaft seal described hereinafter. The nut 77, in the embodiment shown, contacts the lower end of the central hub 57.

The mixer 36 is effective to create the desired flow of the material in the external recirculation loop 31 without the need for a separate circulating pump. Foaming is minimized in the mixing tank 12 because the conduit 34 returns the intensively mixed materials to the tank beneath the upper surface of the materials therein, so that foam does not tend to form on top of the materials in the tank. Moreover, the system is substantially closed so that the amount of air that becomes entrained in the material is minimal. The structure of the external recirculation loop 31, including the mixer head 37, makes it possible more easily to clean and sterilize the apparatus. All of the materials contained in the tank 12 and the external recirculation loop 31 can be drained through the outlet 42. Steam can readily be flowed through the interior of the tank 12 and the loop 31 because of the relatively open internal structure thereof.

The drive shaft 76 used to rotate the mixer head 37 at high speeds extends upwardly out of the external recirculation loop 31 and is drivingly connected to the motor 39. A closure assembly 81 closes the open end 82 of the top leg 33*b* of the T-shaped conduit 33 and prevents escape of the materials along the drive shaft 76. The closure assembly 81 includes a seal housing or casing 83 which is connected by a flanged coupling 84 to the upper end of the top leg 33*b* of the T-shaped conduit 33. An annular plate 86 is positioned over the open end 82 of the top leg 33*b* and is interposed between the seal housing 83 and the top leg 33*b*. A pair of lower and upper elastomeric O-rings or gaskets 87 and 88, respectively, are positioned within a pair of upper and lower annular cavities in the flanged coupling 84 coaxial with the top leg 33*b* whereby to sealingly engage the annular plate 86 and prevent leakage of the material being mixed therealong. Any suitable means can be used to secure together parts of the flanged coupling 84. In the embodiment shown in FIG. 2, a hinged clamping ring 90 is provided for this purpose. For example, the gaskets 87 and 88 can be TRI-CLOVER gaskets and the hinged clamp 90 can be a TRI-CLAMP clamp.

The drive shaft 76 extends upwardly through the central opening in the plate 86 and thence through an axial bore 91 in the seal housing 83. An annular ring 89 is disposed in the upper portion of the bore 91 and is retained therein by a retainer ring 95. The radially inner wall of the ring 89 is radially outwardly spaced from the shaft 76.

Figure 6:
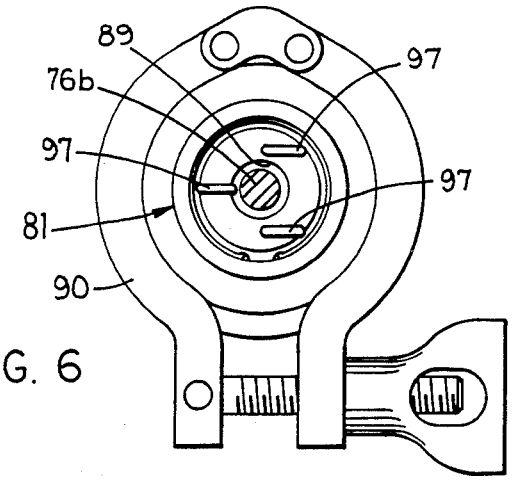
FIG. 6 is a sectional view of a seal assembly for the drive shaft of the mixer according to the invention taken along the line VI—VI in FIG. 2.

A series of pairs of inner and outer elastomeric O-rings 92 and 93, respectively, and a plurality of flexible lip seals 94, are disposed in the bore 91 coaxial with the bore 91 and the shaft 76. In the illustrated embodiment, there are four pairs of O-rings 92 and 93 and four lip seals 94 which are arranged alternately in a vertically stacked relationship, with a pair of the O-rings being disposed lowermost and sealingly contacting the upper surface of plate 86. Each of the lip seals 94 comprises an annular disk having a central opening which is slightly smaller in diameter than the diameter of the enlarged portion **76*b* of the drive shaft. The radially inner portion of each lip seal 94 is smoothly downwardly curved and the radially inner edge thereof touches the surface of the shaft portion 76*b*. The flat, radially outer portion of each lip seal 94 sealingly engages the two associated O-rings 92 and 93 therebelow. The upper face of the radially outer portion of each lip seal 94 similarly sealingly engages the O-rings of the adjacent upper pair, except for the uppermost lip seal 94. The upper face of the uppermost lip seal 94 is engaged by an annular compression member 96. A plurality of T-shaped screws 97, here three screws as shown in FIG. 6, are threadedly secured in the ring 89 and the inner ends thereof abut against the upper surface of the compression member 96. Thus, by adjusting the vertical position of the compression member 96, the stack of lip seals 94 and pairs of O-rings 92, 93, is compressed between the upper face of the annular plate 86 and the lower face of the compression member 96**.

The lip seals 94 and the pairs of O-rings 92, 93 act to minimize leakage in the following manner. Since the lip seals 94 are of slightly smaller diameter than the upper portion **76*b* of the drive shaft 76, each seal 94 is bent slightly axially inwardly when the drive shaft 76 is inserted therethrough from the upper end of the housing 83. The lip seals 94 thus assume the slightly bent conformation shown in FIG. 2, and thereby come into substantial sealing contact with the drive shaft 76 at the upper portion 76*b* thereof. It is preferred that the radially inner portion of each lip seal 94 be bent downwardly (axially inwardly) as shown in FIG. 2 so that any fluid tending to flow upwardly along the shaft portion 76*b*** will be scraped off by the radially inner edges of the lip seals.

The O-rings 92, 93 prevent leakage in the radial direction of the seal. When the screws 97 are sufficiently tightened, the O-rings 92, 93 are resiliently deformed into sealing contact with the adjacent surfaces of the lip seals whereby to prevent materials located radially inwardly thereof from passing toward the radially outermost portions of the enlarged bore portion 91.

The number of lip seals and pairs of O-rings used can be readily varied according to need. The use of four lip seals and four pairs of O-rings, as shown in FIG. 2, is particularly preferred. The lip seals 94 can be made of a flexible plastic sheet-form material.

The drive shaft 76 is coupled by means of a sleeve coupling 98 to a motor shaft 99 which is driven by the motor 39. The motor 39, shaft 99, sleeve coupling 98, and drive shaft 76 together form the previously mentioned drive shaft assembly 38.

In operation, a batch of the liquid and the additive materials will be placed in the tank 12 and the agitator 27 will be rotated until the batch has been blended to the desired degree. Then the high-speed, high-shear mixer will be run to effect homogenization as described above. The agitator 22 and the high-speed, high-shear external mixer 36 are usually run simultaneously during the homogenization portion of the operation. The turbine blade agitator head 27 blends the materials in the mixing tank 12 with the homogenized mixture that is returned from the external recirculation loop 31 so that, over a period of time, substantially all of the original contents of the tank 12 will be flowed through and homogenized in the external recirculation loop 31. When a sufficient time has passed to produce an acceptably homogeneous suspension, emulsion or solution, operation of the high speed mixer 36 is discontinued, and the product outlet 42 is opened to withdraw the final product. Rotation of the agitator 22 will be continued to maintain the contents of the vessel in a mixed condition while same are being withdrawn. The entire batch is then fed through the outlet 44 for further treatment or packaging. Optionally, a portion of the product may be recycled to the tank 12, together with an additional amount of the liquid vehicle or solvent.

Upon conclusion of a run, the tank 12 and external recirculation loop 31 can then, if necessary, be cleaned and sterilized by the introduction of pressurized steam through the steam inlet 21. If necessary, the mixer head can be more thoroughly cleaned at this time by removing the closure assembly 81 and withdrawing the mixer head 37 from the top leg **33*b* of the T-shaped conduit 33**.

Although the present invention has been described with reference to an apparatus for preparing pharmaceutical solutions, emulsions and suspensions on a relatively small scale, embodiments wherein the mixing tank 12 and the external mixer 36 are of different relative sizes are also contemplated.

The fitting or conduit 33 used in the present invention to contain the external mixer 36 can be of various shapes. Even when the fitting is not substantially T-shaped, the stem portion **33*c* must be disposed at an angle relative to the top and bottom leg portions 33*b* and 33*a* respectively sufficient to create the annular flow depicted in FIG. 5. For example, a substantially Y-shaped fitting wherein the portion 33*c* is disposed at a 45° angle relative to the axis of the portions 33*a*, 33*b* could be used in place of the T-shaped fitting 33**.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A mixing apparatus for preparing suspensions, emulsions and solutions, comprising:

container means adapted for holding a mixture of materials to be formed into a suspension, emulsion or solution;

inlet means for feeding said materials into said container means;

outlet means for withdrawing a product from said container means;

an external recirculation loop having a first end communicating with said container means near to the bottom of said container means, and having a second end communicating with said container means near to the bottom of said container means but above said first end, said external recirculation loop comprising a continuous, elongated conduit which extends from said first end to said second end and forms a flow path between said first and second ends so that successive portions of the mixture of materials in said container means can be continuously flowed in series through said external recirculation loop, said external recirculation loop having a branch portion which adjoins and communicates with said continuous, elongated conduit at one end of said branch portion; and mixing means including a rotatable, hollow mixer head substantially completely disposed in said branch portion, said mixer head having wall means defining an internal cavity having a centrally located inlet opening at one end thereof and a plurality of circumferentially spaced-apart radial slots extending from said cavity and defining outlets therefrom, means for rotating said mixer head to draw said mixture from said container means into said first end of said external recirculation loop, then into said internal cavity of said mixer head through said inlet opening, the impel said mixture radially outwardly from said internal cavity through said slots, whereby said mixture is intensely mixed and subjected to high fluid shear effective to homogenize said mixture, said mixture then flowing through said external recirculation loop to said second end thereof, then out of said second end into the interior of said container means, whereby said mixture is continuously recirculated and mixed to form a homogeneous product.

2. An apparatus as claimed in claim 1, wherein said conduit and said branch portion define a substantially T-shaped passage comprised of first and second hollow cross-bar portions which are joined to each other at their adjacent ends and a stem portion which extends transversely to said cross-bar portions, said first cross-bar portion being connected to said first end and said stem portion being connected to said second end, said mixing head being disposed in said second cross-bar portion.

3. An apparatus as claimed in claim 2, wherein said first conduit means comprises an L-shaped pipe which extends laterally and horizontally from said container means, then upwardly to the lower end of said first cross-bar portion of said T-shaped third conduit means.

4. An apparatus as claimed in claim 3, wherein said second conduit means comprises a pipe which extends horizontally from said container means to said stem portion of said T-shaped conduit means.

5. An apparatus as claimed in claim 1, further comprising stirring disposed within said container means for effecting blending of said mixture within said container.

6. An apparatus as claimed in claim 1, wherein said outlet means is formed at the bottom of said container below said first and ends of said external recirculation loop.

7. An apparatus as claimed in claim 1, wherein said hollow mixer head comprises a central, vertically extending sleeve rotatably coupled with said means for rotating said mixer, a central hollow cylinder of larger diameter than said central sleeve, coaxial therewith and radially outwardly spaced therefrom to define said internal cavity therebetween, said central cylinder having a plurality of circumferentially spaced-apart, axially elongated, radial slots therethrough, and a pair of frusto-conical members connected to the opposite axial ends of said central cylinder, respectively, and extending axially outwardly therefrom, said frusto-conical members being narrowest at the axially outermost ends thereof relative to the center of said mixer head, the lower one of said frusto-conical members defining said inlet opening.

8. An apparatus as claimed in claim 7, wherein said mixer head further comprises a plurality of radially extending fins which extend radially outwardly from said central sleeve to said frusto-conical members.

9. An apparatus as claimed in claim 8, wherein at least two of said fins are associated with each of said frusto-conical members, and the fins associated with the lower one of said frusto-conical members are affixed to said lower one of said frusto-conical members and are further affixed to a lower portion of said central sleeve, whereby said lower one of said frusto-conical members forms an integral unit with the fins associated therewith and said central sleeve.

10. An apparatus as claimed in claim 7, wherein said means for rotating said mixer head comprises a drive shaft, a portion of said drive shaft being disposed within said central sleeve coaxially therewith and extending beyond the lower end of said central sleeve, said drive shaft being radially enlarged at a portion thereof above the portion of said drive shaft which extends into said central sleeve, an annular top plate disposed in abutment on the upper side thereof with a shoulder formed at the lower axial end of said radially enlarged portion of said drive shaft, said top plate being in abutment on the lower face thereof with an upper edge of the uppermost one of said frusto-conical members, whereby said top plate prevents the mixture from leaving said mixer head through the top thereof, and means for securing said mixer head for integral rotation with said drive shaft and for securing said mixer head in abutment with said annular top plate, said securing means being fastened on an end portion of said drive shaft which extends beyond the lower axial end of said central sleeve.

11. An apparatus as claimed in claim 1, wherein said means for rotating said mixer head comprises motor means disposed outside of said recirculation loop and drive shaft means rotatably driven by said motor means and extending into said recirculation loop and connected to said mixer head.

12. An apparatus as claimed in claim 11, further comprising a shaft seal assembly mounted on said external recirculation loop, said drive shaft means extending through a central opening in said seal assembly, said seal assembly including a seal housing positioned over and sealing an opening in said external recirculation loop, said seal housing having a central bore therethrough through which said drive shaft means extends, said bore including a radially enlarged portion thereof within the interior of said seal housing, a plurality of pairs of concentric, coplanar, elastic O-rings coaxial with said bore and a plurality of annular, flexible lip seals coaxial with said bore and disposed alternately with said pairs of O-rings in a vertical stack so that radially outer portions of the surfaces of said lip seals are sealingly engaged by said pairs of O-rings, the radially innermost edges of said lip seals contacting and sealingly engaging said drive shaft means disposed in said bore, the innermost pair of said O-rings being in sealing contact with said housing radially outwardly of an end portion of said bore which communicates with said opening in said external recirculation loop, and compression means for pressing said pairs of O-rings against said lip seals whereby said O-rings prevent radial flow of said product past said O-rings and said lip seals prevent axial flow of said mixture past said lip seals along said drive shaft means.

13. An apparatus for preparing sterile suspensions, emulsions and solutions, comprising:

container means adapted for holding a mixture of materials to be formed into a suspension, emulsion or solution;

inlet means formed on said container means for adding said materials into said container means;

outlet means for withdrawing a product suspension, emulsion or solution from said container means;

an external recirculation loop including first conduit means into which a portion of said mixture from said container means is continuously withdrawn, said first conduit means communicating with said container means near the bottom of said container means, and second conduit means communicating with said first conduit means for continuously returning said mixture to said container means, said second conduit means communicating with said container means near the bottom of said container means but above said first conduit means;

mixing means including a hollow mixer head disposed within said external recirculation loop, motor means disposed outside of said recirculation loop, and drive shaft means rotatably driven by said motor means extending into said external recirculation loop and connected to said mixer head for rotating said mixer head, said mixer head being adapted upon rotation thereof to draw said mixture from the interior of said container means through said first conduit means, then into an interior cavity of said mixer head through first opening means formed on a central inner end portion of said mixer head, then impel said mixture radially outwardly from said interior cavity through second opening means formed in a side wall of said mixer head, whereby said mixture is intensely mixed to form said product, then through said second conduit means to the interior of said container means, whereby said mixture is continuously recirculated and mixed to form a homogeneous product; and a shaft seal assembly mounted on said external recirculation loop, said drive shaft means extending through a central opening in said seal assembly, said seal assembly including a seal housing positioned over and sealing an opening in said external recirculation loop, said seal housing having a central bore therethrough through which said drive shaft means extends into and through said seal housing and said opening in said external recirculation loop, said bore including a radially enlarged bore portion within the interior of said seal housing, a plurality of concentric elastic O-rings coaxial with said bore and a plurality of annular, flexible lip seals coaxial with said bore, said lip seals being arranged alternately with said O-rings in a vertical stack so that radially outer portions of the surfaces of said lip seals are sealingly engaged by said O-rings, the radially innermost edges of said lip seals contacting and flexibly sealing said drive shaft means disposed in said bore, at least one axially innermost O-ring being in sealing contact with said housing means radially outwardly of a lower end portion of said bore which communicates with said opening in said external recirculation loop, and compression means for pressing said O-rings against said lip seals, whereby said O-rings prevent radial flow of said mixture past said O-rings and said lip seals prevent axial flow of said mixture past said lip seals.

14. An apparatus as claimed in claim 13, wherein said seal housing comprises a plate adjacent to said opening in said external recirculation loop and having a central opening therein defining said lower end portion of said bore, and an upper casing mounted on said plate, said casing defining said radially enlarged bore portion therein, said axially innermost O-ring being in sealing engagement with the upper surface of said plate.

15. An apparatus as claimed in claim 14, wherein said compression means comprises an annular compression member disposed coaxially with said bore and in face-to-face contact with the axially outermost one of said lip seals, and a plurality of screws threadably secured in said casing, said screws contacting said annular compression member at inner ends thereof, thereby pressing said O-rings and lip seals against each other.

16. An apparatus as claimed in claim 15, wherein said O-rings are disposed in a plurality of layers each comprising two concentric, coplanar O-rings.

17. An apparatus as claimed in claim 13, wherein said lip seals comprise flexible annular disks having circular central openings therein, said central openings being of a diameter slightly less than the diameter of a portion of said drive shaft means in contact therewith, each of said lip seals having a radially innermost portion thereof, which radially innermost portion curves slightly axially inwardly when said drive shaft means is disposed in the central openings of said lip seals.

18. A mixing apparatus for preparing suspensions, emulsions and solutions, comprising:

a tank adapted for holding a mixture of materials to be formed into a suspension, emulsion or solution;

at least one inlet for feeding said materials into said tank;

an outlet formed at the bottom of said tank for withdrawing a product from said tank;

an external recirculation loop including a first pipe which communicates with said tank at a location in the lowermost quarter of said tank, a second pipe which communicates with said tank at a location in the lowermost quarter of said tank but above the location of said first pipe, and a T-shaped fitting connected to, communicating with and forming a flow path between said first and second pipes so that the mixture of materials in said tank can be flowed in series through said first pipe, said T-shaped fitting and said second pipe, said T-shaped fitting having first and second upright hollow coaxial cross-bar portions which are joined together at their adjacent ends and a horizontal stem portion which extends transversely to said cross-bar portions, said first cross-bar portion being connected to and communicating with said first pipe, said stem portion being connected to and communicating with said second pipe so that said first pipe, said first cross-bar portion, said stem portion and said second pipe define a continuous elongated conduit and said second cross-bar portion defines a branch which adjoins and communicates with said first cross-bar portion and said stem portion; and a mixer including a hollow rotatable mixer head disposed in said second cross-bar portion of said T-shaped fitting and a drive shaft extending into said recirculation loop for rotating said mixer head, said mixer head comprising a central, vertically extending sleeve rotatably coupled with said drive shaft, a central hollow cylinder of larger diameter than said central sleeve, coaxial therewith and radially outwardly spaced therefrom to define an internal cavity in said mixer head having a centrally located inlet opening at the inner end thereof, said central cylinder having a plurality of circumferentially spaced-apart, axially elongated, radial slots therethrough, and a pair of frusto-conical members connected to the opposite axial ends of said central cylinder, respectively, and extending axially outwardly therefrom, said frusto-conical members being narrowest at the axially outermost ends thereof relative to the center of said mixer head, the lower one of said frusto-conical members defining said inlet opening in said mixer head, said mixer head being adpated upon rotation thereof to draw said mixture from said tank through said first pipe, then through said cross-bar portions and into said internal cavity of said mixer head through said inlet opening therein, then impel said mixture radially outwardly from said internal cavity through said slots, whereby said mixture is intensely mixed and subjected to fluid shear effective to form a homogeneous product, said mixture then flowing through said stem portion into said second pipe, then through said second pipe to the interior of said tank, whereby said mixture is continuously recirculated and mixed to form said product.

19. A mixing apparatus for preparing suspensions, emulsions and solutions, comprising:

a container adapted for holding a mixture of materials to be formed into a suspension, emulsion or solution;

an inlet for feeding said materials into said container;

an outlet for withdrawing a product from said container;

an external recirculation loop having first and second ends communicating with spaced-apart zones in said container, said external recirculation loop comprising a continuous, elongated conduit which extends from said first end to said second end and forms a flow path between said first and second ends so that successive portions of the mixture of materials in said container can be continuously flowed in series through said external recirculation loop, said external recirculation loop having a branch portion which adjoins and communicates with said continuous, elongated conduit; and a rotatable, hollow mixer head substantially completely disposed in said branch portion, said mixer head having wall means defining an internal cavity having a centrally located inlet opening at one end thereof and a plurality of circumferentially spaced-apart radial slots extending from said cavity and defining outlets therefrom, means for rotating said mixer head to draw said mixture from said container into said first end of said external recirculation loop, then into said internal cavity of said mixer head through said inlet opening, the impel said mixture radially outwardly from said internal cavity through said slots, whereby said mixture is intensely mixed and subjected to high fluid shear effective to homogenize said mixture, said mixture then flowing through said external recirculation loop to said second end thereof, then out of said second end into the interior of said container, whereby said mixture is continuously recirculated and mixed to form a homogeneous product.

* * * * *

UNITED STATES PATENT AND TRADEMARK OFFICE

CERTIFICATE OF CORRECTION

PATENT NO. : 4 515 482

DATED : May 7, 1985

INVENTOR(S) : Frederic H. Schadewald

It is certified that error appears in the above-identified patent and that said Letters Patent is hereby corrected as shown below:

Column 9, line 50; delete "first".
delete "means".
line 53; change "third conduit means" to ---passage---.
line 55; delete "second".
delete "means".
line 57; change "conduit means" to ---passage---.
line 59; after "stirring" insert ---means---.
line 62; after "container" insert ---means---.
line 68; after "mixer" and before the comma insert ---head---.
Column 14, line 29; change "the" to ---then---.

Signed and Sealed this

*Tenth* Day of *December 1985*

[SEAL]

*Attest:*

DONALD J. QUIGG

*Attesting Officer*

*Commissioner of Patents and Trademarks*